United States Patent [19]

Scott

[11] 3,971,442

[45] July 27, 1976

[54] METHOD OF CLEANING TUBULAR MEMBERS ON A RIG FLOOR

[76] Inventor: Thomas W. Scott, P.O. Box 51407, O.C.S., Lafayette, La. 70501

[22] Filed: Jan. 6, 1975

[21] Appl. No.: 538,748

[52] U.S. Cl. ..... 166/315; 175/84

[51] Int. Cl.[2] ..... E21B 23/00

[58] Field of Search ..... 29/240; 15/88, 104.03, 15/104.04; 134/6, 30, 37; 166/75, 77.5, 82, 85, 315; 175/84

[56] References Cited

UNITED STATES PATENTS

| | | | |
|---|---|---|---|
| 2,305,079 | 12/1942 | Heldenbrand | 15/88 |
| 2,661,494 | 12/1953 | Crookston et al. | 15/104.04 |
| 2,682,068 | 6/1954 | Harrigan | 15/88 |
| 3,044,907 | 7/1962 | Bernhardt | 15/104.04 |
| 3,129,009 | 4/1964 | Simpson | 166/82 |
| 3,285,778 | 11/1966 | Hauk | 15/104.03 |
| 3,436,783 | 4/1969 | McCartney | 134/6 |
| 3,877,529 | 4/1975 | Litchfield | 166/315 |

*Primary Examiner*—Ernest R. Purser
*Assistant Examiner*—Jack E. Ebel

[57] ABSTRACT

Tubular members are positioned in a drilling rig relative to the rig floor so that the threaded pin end of the tubular member may be encapsulated with a thread cleaner to clean the threads immediately prior to connecting the threaded pin end of the tubular member with the upwardly facing box of a well string supported adjacent the rig floor.

2 Claims, 2 Drawing Figures

METHOD OF CLEANING TUBULAR MEMBERS ON A RIG FLOOR

SUMMARY OF THE INVENTION

Numerous arrangements have been heretofore proposed and used for cleaning tubular members, such as tubular members used in drilling oil, gas water wells and the like on a rack or the like prior to moving the tubular members to the drilling rig floor or other location for use.

Where the tubular member is to be connected into a well string there may be, in some instances, a substantial amount of time delay before actually threadedly connecting the tubular members into the well string which is suspended from the drilling rig floor and extends downwardly into the ground, and it is not uncommon in such interval for inclement weather to adversely affect the cleaning operation or the dope compound placed thereon so as to render such cleaning operation substantially ineffective.

Other methods have been attempted to clean the pin end of a tubular member immediately prior to connecting into a well string having a threaded box end facing upwardly, which well string is supported adjacent the rig floor, such methods including employing wire brushes or other cleaning devices which are manually applied to the threaded end. This arrangement however, is not most effective in that it is time consuming, the manner of suspension of the tubular member requires that it be manually grasped or firmly held while an attempt is made simultaneously to brush the threaded pin end.

Other arrangements and apparatuses have been employed for cleaning threads, but so far as known to applicant, no one heretofore has provided a method for cleaning tubular members on the rig floor of a drilling rig immediately prior to connecting the tubular member into the well string.

An object of the present invention therefore is to provide a method of cleaning the threaded pin end of a tubular member by suspending the tubular member so that the threaded pin end thereof faces downwardly in the drilling rig so that such threaded pin end may be encapsulated by a thread cleaner, the thread cleaner thereafter actuated so as to clean the threaded pin end and then removing the thread cleaner so that the tubular member may be subsequently connected into the upwardly facing box end of a well string supported adjacent the drilling rig floor.

Yet a further object of the present invention is to provide a method of connecting a joint of pipe having threaded box and pin ends into a well string suspended in a well bore with a threaded box facing upwardly above a rig floor including the steps of lifting the tubular member to elevate the threaded pin end thereof above the rig floor, encapsulating the pin end of the tubular member with a thread cleaner, actuating the thread cleaner to clean the pin end threads of the tubular member and then removing the thread cleaner from the pin end of the tubular member to thereby expose it for connection with the upwardly facing threaded box of the well string.

Yet a further object of the present invention is to provide a method of connecting a joint of pipe having threaded box and pin ends into a well string suspended in a well bore with a threaded box facing upwardly above a rig floor including the steps of lifting the tubular member to elevate the threaded pin end thereof above the rig floor, encapsulating the pin end of the tubular member with a thread cleaner, actuating the thread cleaner to clean the pin end threads of the tubular member and then removing the thread cleaner from the pin end of the tubular member to thereby expose it for connection with the upwardly facing threaded box of the well string and rotating the joint of pipe to threadedly engage the threaded pin of the joint of pipe with the upwardly facing box of the well string.

Other objects and advantages of the present invention will become more readily apparent from a consideration of the following description and drawing.

BRIEF DECRIPTION OF THE DRAWING

FIG. 1 is a partial schematic illustrating a drilling rig, a drilling rig floor, a rotary table supported on the drilling rig floor for suspending a well string therein in elevated position above the rig floor with the threaded box end of the well string facing upwardly, and a tubular member supported in elevated position relative to the rig floor with a thread cleaner mounted so as to encapsulate the lower threaded pin end of the tubular member for cleaning thereof prior to connecting the pin end of the tubular member with a box end of the well string; and FIG. 2 is similar to FIG. 1 and illustrates a thread cleaner encapsulating the lower threaded pin end of the tubular member for cleaning thereof immediately prior to connecting the tubular member into the well string.

DESCRIPTION OF THE PREFERRED EMBODIMENT

It can be appreciated that any suitable form of thread cleaner may be employed in practicing the present invention which is constructed and arranged so as to encapsulate, or enclose, the lower threaded pin end of a suspended tubular member for cleaning thereof. For example, the thread cleaner may comprise a housing having a plurality of brushes rotatably mounted therein, such housing having a closure with an opening to enable the tubular member to be positioned therein and the rotatable brushes thereafter actuated for cleaning of the threads.

In some instances, it may be more desirable to clean the threads with a fluid medium such as compressed air, or with a liquid such as a solvent without employing the brushes. Therefore, it can be appreciated that the following discussion of the form of apparatus, or arrangements, which may be employed to clean the encapsulated threaded pin end of the tubular member are for purposes of illustration only, and are not intended as limitations upon the present invention.

Figure 1:
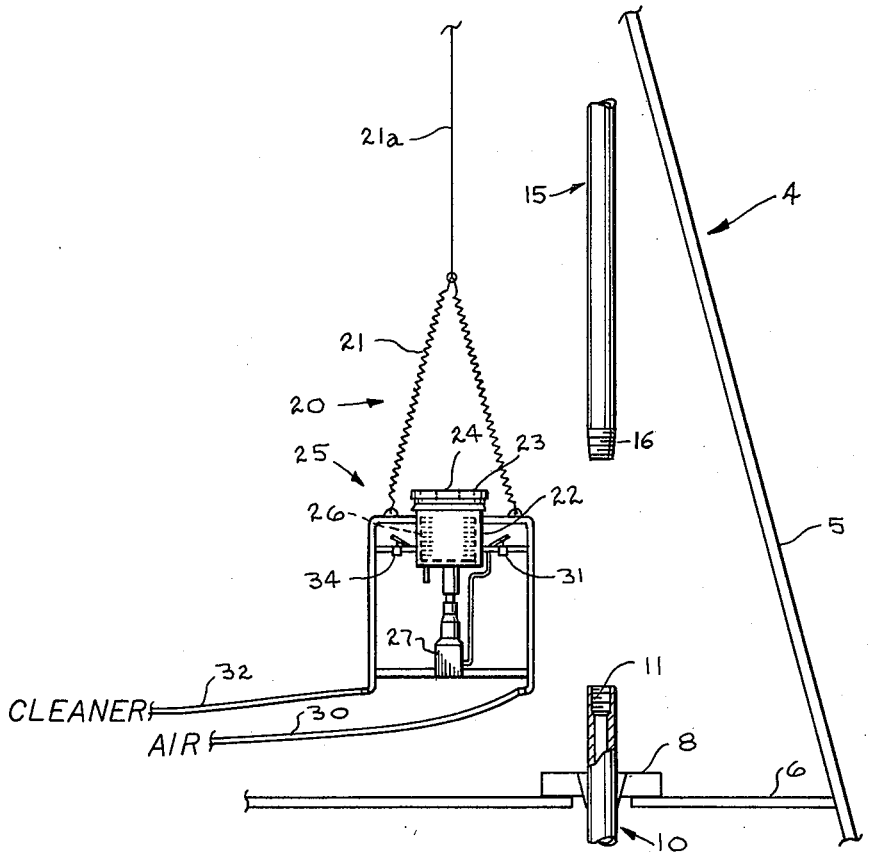

Attention is first directed to FIG. 1 of the drawings wherein a leg 5 of a drilling rig referred to generally by the numeral 4 is shown as extending upwardly from a support surface (not shown), such drilling rig having the customary crown block (not shown) at the upper end thereof. The drilling rig 4, includes a floor 6, which provides a work area during drilling operations for connecting tubular members together to form a well string, for disconnecting tubular members when the well string is withdrawn from the well bore, and for conducting various other operations during the drilling and completion of an oil, gas or other type well.

In FIG. 1, a rotary table 8 is schematically illustrated as being supported adjacent the drilling rig floor 6, which rotary table 8 is well known to those skilled in the art and is employed for imparting rotation to the drill string for drilling a well bore. The well string referred to generally at 10 supported or suspended from the rotary table may be a drill string, tubing string, or casing string. Therefore, it can be appreciated that in the present instance where the method of the present invention is described in detail with regard to a drilling string, such is intended by way of illustration only and is not intended in any limiting manner.

The well string 10 is formed of a plurality of sections of tubular member which have been threaded together to form a well string of suitable extent.

Where the well string 10 is a drill string, it will have a bit at the lower end thereof so that when rotation is imparted by the rotary table 8 to the well string 10, the well bore is progressively deepened in the earth's surface.

As drilling proceeds, it is necessary to sequentially join additional sections of tubular members into the well string 10, which tubular members are positioned on a rack adjacent the rig floor 6.

The crown block hoisting arrangement of the drilling rig is generally employed along with other well known apparatus for maneuvering the tubular member onto the rig floor and for connection into the well string.

In FIG. 1, a tubular joint of pipe is referred to generally by the numeral 15 and is shown as having been hoisted or suspended in the derrick 4 and having a threaded pin end 16 thereon facing downwardly. Also, it will be noted that the well string 10 is provided with a threaded box 11 facing upwardly so that the tubular member 15 may be threadedly secured or connected into the well string 10 and form a part thereof.

A thread cleaner is illustrated generally at 20 and is shown as being supported adjacent the rig floor by suitable means such as the springs or resilent means 21 and cable 21*a*, such thread cleaner including an arrangement or housing 22 which may have a cover or closure 23 thereon with an opening 24 therein so that such housing may be positioned to encapsulate or enclose the lower threaded pin end 16 of the tubular member 15.

As previously noted any suitable thread cleaner arrangement may be employed, and as illustrated the thread cleaner arrangement includes a plurality of brushes 26 mounted in the housing 22 and connected to a suitable power source 27 so that such brushes may be rotated when desired. Additionally, air from a source (not shown) is conducted through a conduit 30 to the housing 22 with a suitable valving arrangement 31 for controlling flow of the air into the housing 22 where a thread cleaner without brushes is employed and it is desired to air clean the threads. Where brushes are employed, the valving arrangement 31 controlls flow of air to the power means 27 which may be in the form of an air actuated motor for rotating the brushes 26.

Also if desired a suitable solvent or cleaner may be conducted through the line 32 to the housing 22, the flow of such cleaner being controlled by suitable valving arrangement 34.

It will be noted that the springs 21 are connected to a framework referred to generally at 25 which is connected to the thread cleaner 20 to thereby support the thread cleaner 20 adjacent the drilling rig floor so that it can be easily moved into position to clean the threaded pin end of the tubular member and thereafter moved out of the way when the tubular member is connected into the well string.

When it is desired to connect a tubular member or joint of pipe 15 into the well string 10, the tubular member 15 is moved from the pipe rack and hoisted or suspended in the drilling rig so that the threaded pin end 16 thereof faces downwardly in an elevated relationship relative to the rig floor 6 as shown in FIG. 1.

By reason of the spring suspension along with the cable suspension 21*a* connected with the springs, the thread cleaner 20 can then be manually moved and positioned so as to encapsulate or enclose the lower threaded pin end 16 of the tubular member 15 and by actuating the valves 31 and 34 rotation is imparted to the brushes in the housing 22 and solvent or cleaner is simultaneously injected into the housing through line 32 under pressure so that as the brushes 26 are rotated to clean the encapsulated or enclosed threaded pin end 16, solvent is sprayed thereon. The solvent is then discharged from the housing through a conduit as shown.

In some instances, it may be desirable to dispense with the brush arrangement and conduct a cleaner fluid and air under pressure to the brushes to effect the cleaning by means of compressed air along with the solvent or cleaner.

However, regardless of the form of thread cleaner employed, after the encapsulated threaded pin end 16 of the tubular member 15 has been cleaned, the thread cleaner 20 is then manually moved away from the tubular member 15 so as to expose the lower end 16 thereof for connection with the upwardly facing box 11 of the well string 10.

If desired, suitable thread compound may be applied to the threads, and the threaded pin end 16 lowered into engagement with the upwardly facing threaded box 11 of the well string 10 whereupon rotation may be imparted to the tubular member 15 for connection thereof into the well string.

Thereafter drilling or other operations may continue.

Figure 2:
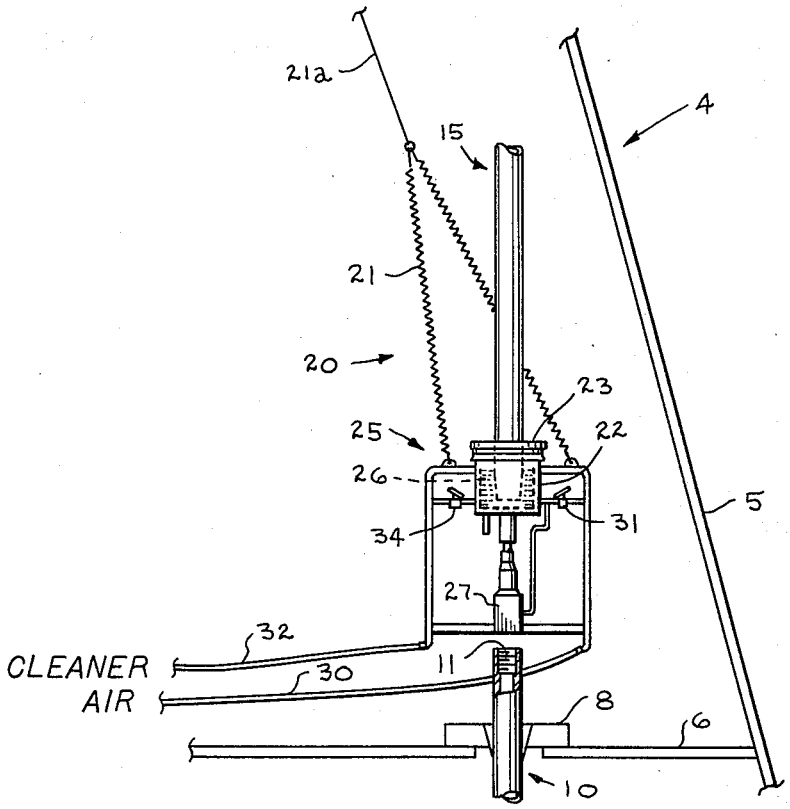

FIG. 2 illustrates the position of the thread cleaner 20 when it has been moved into position to encapsulate or enclose the threaded pin end 16 of the tubular member 15, and illustrates in dotted line the relationship of the threaded pin end within the encapsulating housing or enclosure 22 for engagement by the form of thread cleaner described in connection with the present method; however, as previously noted, any suitable form of thread cleaner may be employed without departing from the scope and spirit of the present invention.

It can be appreciated that the above steps may be sequentially repeated each time a tubular member 15 is connected into the well string 10.

In those instances where the well string is a production tubing, casing or other tubular member extending into the well bore, the method of the present invention is the same.

From the foregoing, it can be appreciated that the present invention provides a method of cleaning the threaded pin end of a tubular member immediately prior to connecting it into a well string, as well as a method of connecting joints of pipe into a well string to form a well string.

The foregoing disclosure and description of the invention are illustrative and explanatory thereof, and various changes in the size, shape, and materials as well as in the details of the illustrated construction may be made without departing from the spirit of the invention.

What is claimed is:

1. A method of cleaning the threaded pin end of a tubular member to be threadedly connected into the upwardly facing threaded box end of the uppermost tubular member of a well string suspended from a drilling apparatus, comprising the steps of:

maintaining a thread cleaner apparatus suitable for encircling and cleaning the threaded pin end of the tubular member in a standby position adjacent the rig floor, said thread cleaner apparatus being physically mounted upon said drilling apparatus for vertical and lateral movement relative thereto;

hoisting the tubular member to be cleaned into a selected position above the upwardly-facing threaded box end of the uppermost tubular member of the well string whereby the pin end of the tubular member to be cleaned faces downwardly;

moving the thread cleaner apparatus from its standby position into a selected position for cleaning the threaded pin end of the tubular member whereby the threaded pin end of the tubular member is encircled by the thread cleaner apparatus;

actuating the thread cleaner apparatus to clean the threaded pin end of the tubular member in the vicinity of the rig floor; and removing the thread cleaner apparatus from its cleaning position encircling the threaded pin end of the tubular member whereby the threaded pin end of the tubular member is exposed for immediate connection with the upwardly facing threaded box of the uppermost tubular member.

2. A method of connecting a joint of pipe having threaded box and pin ends into a well string suspended from a drilling apparatus in a well bore wherein the uppermost joint of pipe in the well string presents a threaded box facing upwardly above the rig floor, comprising the steps of:

maintaining a thread cleaner apparatus suitable for encircling and cleaning the threaded pin end of the tubular member in a standby position adjacent the rig floor, said thread cleaner apparatus being physically connected to said drilling apparatus for vertical and lateral movement relative thereto;

lifting the joint of pipe to be connected into the well string whereby the threaded pin end of the joint of pipe faces downwardly above the rig floor;

moving the thread cleaner apparatus from its standby position into the desired cleaning position whereby the threaded pin end of the joint of pipe is encircled by the thread cleaner apparatus;

actuating the thread cleaner apparatus to clean the pin end threads of the joint of pipe;

removing the thread cleaner apparatus from the threaded pin end of the joint of pipe whereby the pin end of the joint of pipe is exposed for immediate connection with the upwardly facing threaded box of the uppermost joint of pipe of the well string;

lowering the cleaned threaded pin end of the joint of pipe into the box of the uppermost joint of pipe of the well string for threaded engagement; and rotating the joint of pipe to threadedly engage the threaded pin end of the uppermost joint of pipe of the well string.

* * * * *